US006939185B2

(12) United States Patent
Matsuda et al.

(10) Patent No.: US 6,939,185 B2
(45) Date of Patent: Sep. 6, 2005

(54) EXHAUST SYSTEM FOR SMALL WATERCRAFT AND PERSONAL WATERCRAFT

(75) Inventors: Yoshimoto Matsuda, Kobe (JP); Makoto Yamamoto, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/763,465

(22) Filed: Jan. 22, 2004

(65) Prior Publication Data

US 2004/0166747 A1 Aug. 26, 2004

(30) Foreign Application Priority Data

Jan. 23, 2003 (JP) ..... 2003-014225

(51) Int. Cl.[7] ..... B63H 21/38
(52) U.S. Cl. ..... 440/89 J
(58) Field of Search ..... 440/89 R, 89 J, 440/89 F

(56) References Cited

U.S. PATENT DOCUMENTS 4,713,029 A * 12/1987 Ford ..... 440/89 R
5,045,005 A * 9/1991 Miles, Jr. ..... 440/89 R
5,554,058 A * 9/1996 LeQuire ..... 440/89 R
6,273,772 B1 * 8/2001 Smullin ..... 440/89 R
6,290,557 B1 * 9/2001 Yokoya ..... 440/89 R
6,755,705 B1 * 6/2004 Slattery ..... 440/89 J
2002/0022416 A1 * 2/2002 Lecours et al. ..... 440/89

FOREIGN PATENT DOCUMENTS

JP 08-119196 5/1996

* cited by examiner

*Primary Examiner*—Ed Swinehart
(74) *Attorney, Agent, or Firm*—Alleman Hall McCoy Russell & Tuttle LLP

(57) ABSTRACT

An exhaust system for a small watercraft is disclosed, wherein the exhaust system includes an exhaust chamber having a predetermined volume, within which an exhaust gas discharged from an engine flows, the exhaust gas containing water supplied at a position of the exhaust system, and an exhaust pipe having an upstream end portion in a flow passage of the exhaust gas, which is connected to the exhaust chamber, the exhaust pipe being configured to discharge the exhaust gas from the exhaust chamber, wherein the upstream end portion of the exhaust pipe is configured to protrude into the exhaust chamber to a vicinity of a lower end of the exhaust chamber and has an upstream opening end face that opens substantially downward so as to be spaced apart a predetermined distance from an inner surface of the exhaust chamber, which is opposed to upstream opening end face.

5 Claims, 6 Drawing Sheets

EXHAUST SYSTEM FOR SMALL WATERCRAFT AND PERSONAL WATERCRAFT

BACKGROUND OF THE INVENTION

1. Field of the Invention

The present invention relates to an exhaust system for a small watercraft. More particularly, the present invention relates to an exhaust system capable of reducing noise of exhaust gas during a low-speed operation of an engine, and a jet-propulsion personal watercraft having the exhaust system.

2. Description of the Related Art

In recent years, jet-propulsion personal watercraft have been widely used in leisure, sport, rescue activities, and the like. The personal watercraft is equipped with an engine mounted within a space surrounded by a hull and a deck. The engine is configured to drive a water jet pump, which pressurizes and accelerates water sucked from a water intake generally provided on a bottom surface of the hull and ejects it rearward from an outlet port of the water jet pump. As the resulting reaction, the personal watercraft is propelled forward.

Japanese Patent No. 3290037 discloses that an exhaust gas from an engine is discharged outside a watercraft through an exhaust system comprising an exhaust manifold, a muffler, pipes connecting these, and the like. In an exhaust system mounted in some personal watercraft, water is supplied to an exhaust gas flowing inside to reduce an energy of the exhaust gas, thereby reducing noise of the exhaust gas.

The exhaust system configured to supply water to the exhaust gas is comprised of an exhaust manifold connected to an exhaust port of an engine, a first exhaust pipe connected to a downstream side of the exhaust manifold, a water muffler connected to a downstream side of the first exhaust pipe and having a predetermined volume, a second exhaust pipe configured to allow the water muffler to communicate with the outside of the watercraft, and the like. In general, the first exhaust pipe connecting the exhaust manifold to the water muffler is provided with a water-supply portion configured to supply water to the exhaust gas flowing inside. In this construction, while the exhaust gas from the engine flows within the exhaust manifold, the first exhaust pipe, the water muffler, and the second exhaust pipe, the exhaust gas is cooled by the water supplied from the water-supply portion to allow the energy to be reduced, and is thereafter discharged outside.

Internal state of the water muffler varies depending on an engine speed. For example, since a high-temperature and large-volume exhaust gas flows within the water muffler at a high speed during a high engine speed, the water supplied to an inside of the exhaust system is diffused and becomes mist. During this state, the energy of the exhaust gas is reduced most, and noise of the exhaust gas is correspondingly reduced most. On the other hand, since the exhaust gas flows with a relatively low speed during a low engine speed, the water supplied to the exhaust system tends to drop to and remain in an inner bottom portion of the water muffler.

In order to discharge the water remaining in the inner bottom portion of the water muffler outside the watercraft by using the exhaust gas, the second exhaust pipe configured to allow the water muffler to communicate with the outside of the watercraft, is provided such that its upstream end in a flow passage of the exhaust gas protrudes and opens within the water muffler. In this construction, if the water reaches a vicinity of the upstream end of the second exhaust pipe in the inner bottom portion of the water muffler, part of the water is pushed from an opening of the upstream end of the second exhaust pipe outside the watercraft through the second exhaust pipe by the exhaust gas flowing from the water muffler to the second exhaust pipe. Since the exhaust gas is discharged together with the water within the water muffler, the exhaust noise being emitted outside the watercraft is reduced. The upstream end of the second exhaust pipe is located above to be sufficiently spaced apart from a inner bottom surface of the water muffler, in order to reduce a back pressure in the muffler.

However, shaking the body of the watercraft agitates the water within the water muffler and causes turbulence therein. The turbulent water within the water muffler opens and closes the opening of the upstream end of the second exhaust pipe protruding into the water muffler, thereby causing a relatively large noise to be generated. This noise forms part of the exhaust noise emitted outside the watercraft, and makes it difficult to reduce the exhaust noise.

In particular, in the construction in which the upstream end of the second exhaust pipe is spaced relatively apart from the inner bottom surface within the water muffler, a large amount of water remains in the water muffler, and the turbulent water due to shaking of the body increases. Therefore, the exhaust noise caused by opening and closing of the opening of the upstream end increases. In this case, since a sound-pressure level of the exhaust noise is very high in a frequency range which is unpleasant to human beings, it is desirable to minimize this sound-pressure level. In addition, since a substantial volume as an expansion space of the water muffler decreases due to the volume of the water remaining therein, a muffling effect of an exhaust chamber is reduced.

Nonetheless, it is difficult to reduce the exhaust noise unpleasant to the human beings by increasing the volume of the water muffler. Such a condition occurs in small watercraft having a water muffler within an exhaust system therein, other than the personal watercraft.

SUMMARY OF THE INVENTION

The present invention addresses the above described condition, and an object of the present invention is to provide an exhaust system for a small watercraft capable of reducing exhaust noise during a low-speed operation of an engine and a personal watercraft comprising the exhaust system.

According to one aspect of the present invention, there is provided an exhaust system for a small watercraft, comprising an exhaust chamber having a predetermined volume, within which an exhaust gas discharged from an engine flows, the exhaust gas containing water supplied at a position of the exhaust system, and an exhaust pipe having an upstream end portion in a flow passage of the exhaust gas, which is connected to the exhaust chamber, the exhaust pipe being configured to discharge the exhaust gas from the exhaust chamber, wherein the upstream end portion of the exhaust pipe is configured to protrude into the exhaust chamber to a vicinity of a lower end of the exhaust chamber and has an upstream opening end face that opens substantially downward in the exhaust chamber so as to be spaced apart a predetermined distance from an inner surface of the exhaust chamber which is opposed to the upstream opening end face.

In this construction, water remaining within the exhaust chamber can be reduced while inhibiting a back pressure of the exhaust noise. Therefore, the exhaust noise can be reduced during a low engine speed while inhibiting degradation of engine performance.

The predetermined distance between the inner surface of the exhaust chamber and the upstream opening end face may satisfy a formula represented by:

$$D/3 \leqq L \leqq D$$

where L is a distance between the upstream opening end face of the exhaust pipe and the inner surface of the exhaust chamber, which is opposed to the upstream opening end face and D is an inner diameter of the upstream end portion of the exhaust pipe.

By setting the distance between the upstream opening end face of the exhaust pipe and the inner surface of the exhaust chamber within a range represented by the formula $D/3 \leqq L \leqq D$, it is possible to inhibit degradation of the engine performance and reduce the exhaust noise effectively in a proper balance.

The upstream opening end face of the exhaust pipe may be substantially horizontal. In this construction, the exhaust noise can be further reduced.

The exhaust chamber may comprise a first exhaust chamber provided on an upstream side in the flow passage of the exhaust gas and a second exhaust chamber provided on a downstream side in the flow passage of the exhaust gas and configured to communicate with the first exhaust chamber through a second exhaust pipe, and the upstream end portion of the exhaust pipe may be connected to the second exhaust chamber.

Some small watercraft is equipped with an exhaust system comprising the first exhaust chamber and the second exhaust chamber in the flow passage of the exhaust gas. In such an exhaust system, reduction of the exhaust noise can be achieved while inhibiting degradation of engine performance. More preferably, the structure of the upstream end portion of the second exhaust pipe is shaped to be identical to that of the upstream end portion of the exhaust pipe, which is connected to the second exhaust chamber. The same effects are provided in the exhaust system comprising three or more exhaust chambers.

According to another aspect of the present invention, there is provided a water-jet propulsion personal watercraft, comprising an engine configured to drive a propulsion mechanism of the watercraft, an exhaust chamber having a predetermined volume, through which an exhaust gas discharged from the engine flows, the exhaust gas containing water supplied at a position of an exhaust system equipped in the watercraft, and an exhaust pipe having an upstream end portion in a flow passage of the exhaust gas, which is connected to the exhaust chamber, the exhaust pipe being configured to discharge the exhaust gas from the exhaust chamber, wherein one end portion of the exhaust pipe is configured to protrude into the exhaust chamber to a vicinity of a lower end of the exhaust chamber and has an upstream opening end face that opens substantially downward in the exhaust gas so as to be spaced apart a predetermined distance from an inner surface of the exhaust chamber which is opposed to the upstream opening end face.

The water-jet propulsion personal watercraft, which is one type of small watercraft, is typically used on water near the shore. It is therefore desirable to minimize noise of exhaust gas discharged from the watercraft. The personal watercraft constructed as describe above is capable of reducing the exhaust noise. Therefore, while the personal watercraft is traveling near the shore, people on the shore are not annoyed by the exhaust noise emitted from the watercraft.

The above and further objects and features of the invention will more fully be apparent from the detailed description with accompanying drawings.

DETAILED DESCRIPTION OF THE PREFERRED EMBODIMENTS

Figure 1:
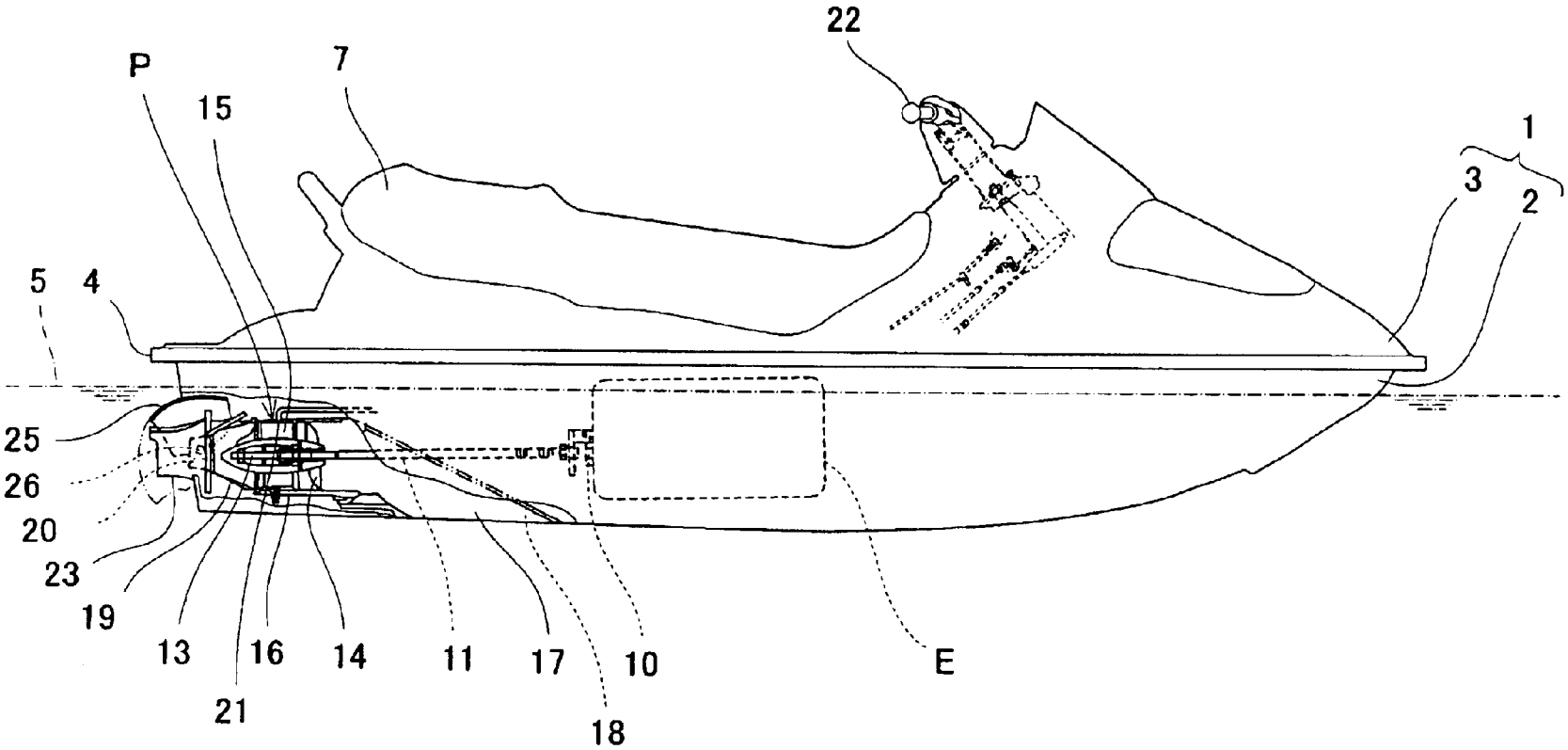
FIG. 1 is a side view of a personal watercraft according to an embodiment of the present invention.

Hereinafter, an embodiment of a personal watercraft of the present invention will be described with reference to the accompanying drawings. The personal watercraft in FIG. 1 is a straddle-type personal watercraft provided with a seat 7 straddled by a rider. A body 1 of the watercraft comprises a hull 2 and a deck 3 covering the hull 2 from above. A line at which the hull 2 and the deck 3 are connected over the entire perimeter thereof is called a gunnel line 4. In FIG. 1, reference numeral 5 denotes a waterline in a certain condition of the personal watercraft of this embodiment.

Figure 2:
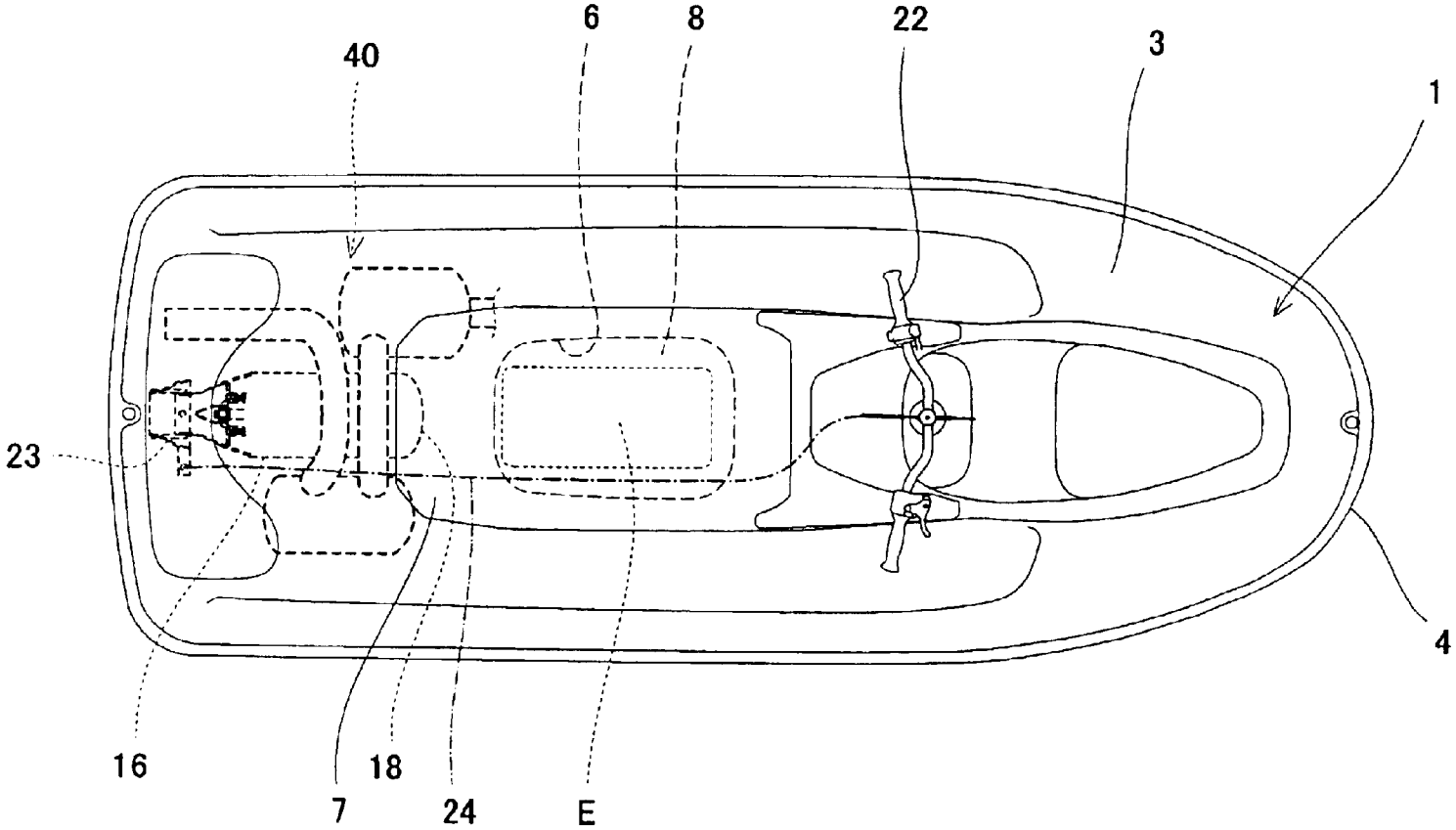
FIG. 2 is a plan view of the personal watercraft in FIG. 1.

As shown in FIG. 2, a deck opening 6, which has a substantially rectangular shape as seen from above, is formed at a substantially center section of the deck 3 in the upper portion of the body 1 such that its longitudinal direction corresponds with the longitudinal direction of the body 1. The seat 7 is removably mounted over the opening 6.

An engine room 8 is provided in a space defined by the hull 2 and the deck 3 below the deck opening 6. An engine E is mounted within the engine room 8 and configured to drive a water jet pump P that propels the watercraft. The engine room 8 has a convex-shaped transverse cross-section and is configured such that its upper portion is smaller than its lower portion. In this embodiment, the engine E is an in-line four-cylinder four-cycle engine.

As shown in FIG. 1, the engine E is mounted such that a crankshaft 10 extends along the longitudinal direction of the body 1. An output end of the crankshaft 10 is rotatably coupled integrally with a pump shaft 13 of a water jet pump P provided on the rear side of the body 1 through a propeller shaft 11. An impeller 14 is attached on the pump shaft 13 of the water jet pump P. Fairing vanes 15 are provided behind the impeller 14. The impeller 14 is covered with a pump casing 16 on the outer periphery thereof.

A water intake 17 is provided on the bottom of the body 1. The water intake 17 is connected to the pump casing 16 through a water passage 18. The pump casing 16 is connected to a pump nozzle 19 provided on the rear side of the body 1. The pump nozzle 19 has a cross-sectional area that gradually reduces rearward, and an outlet port 20 is provided on the rear end of the pump nozzle 19.

Water outside the watercraft is sucked from the water intake 17 and fed to the water jet pump P. The water jet pump P pressurizes and accelerates the water, and the fairing vanes 15 guide water flow behind the impeller 14. The water is ejected through the pump nozzle 19 and from the outlet port 20 and, as the resulting reaction, the watercraft obtains a propulsion force.

As shown in FIG. 2, the water passage 18 and the following pump casing 16 are provided in a rear portion of the body 1 so as to extend through a substantially center position in a lateral direction of the watercraft and along the longitudinal direction of the body 1. And, an exhaust system 40, to be described later, traverses over the water passage 18 and the pump casing 16 within the body 1. An exhaust gas from the engine E is discharged outside the watercraft through the exhaust system 40.

The engine E of this embodiment has an open-looped cooling system. As shown in FIG. 1, a water-drawing port 21 is provided at a predetermined position of an upper portion of the pump casing 16. And, some of the water pressurized by the water jet pump P is drawn into the body 1 through the water-drawing port 21 for use as cooling water to cool components of the engine E, and is supplied to a cooling system configured to cool the engine E.

A bar-type steering handle 22 is provided on a front portion of the deck 3. The handle 22 is connected to a steering nozzle 23 provided behind the pump nozzle 19 through a cable 24 in FIG. 2. When the rider rotates the handle 22 clockwise or counterclockwise, the steering nozzle 23 is swung toward the opposite direction so that the direction of the water being ejected through the pump nozzle 19 can be changed, and the watercraft can be correspondingly turned to any desired direction while the water jet pump P is generating the propulsion force.

As shown in FIG. 1, a bowl-shaped reverse deflector 25 is provided on the rear side of the body 1 and on an upper portion of the steering nozzle 23 such that it can vertically swing around a horizontally mounted swinging shaft 26. When the deflector 25 is swung downward to a lower position around the swinging shaft 26 so as to be located behind the steering nozzle 23, the water being ejected rearward from the steering nozzle 23 is ejected substantially forward. As the resulting reaction, the personal watercraft moves rearward.

Figure 3:
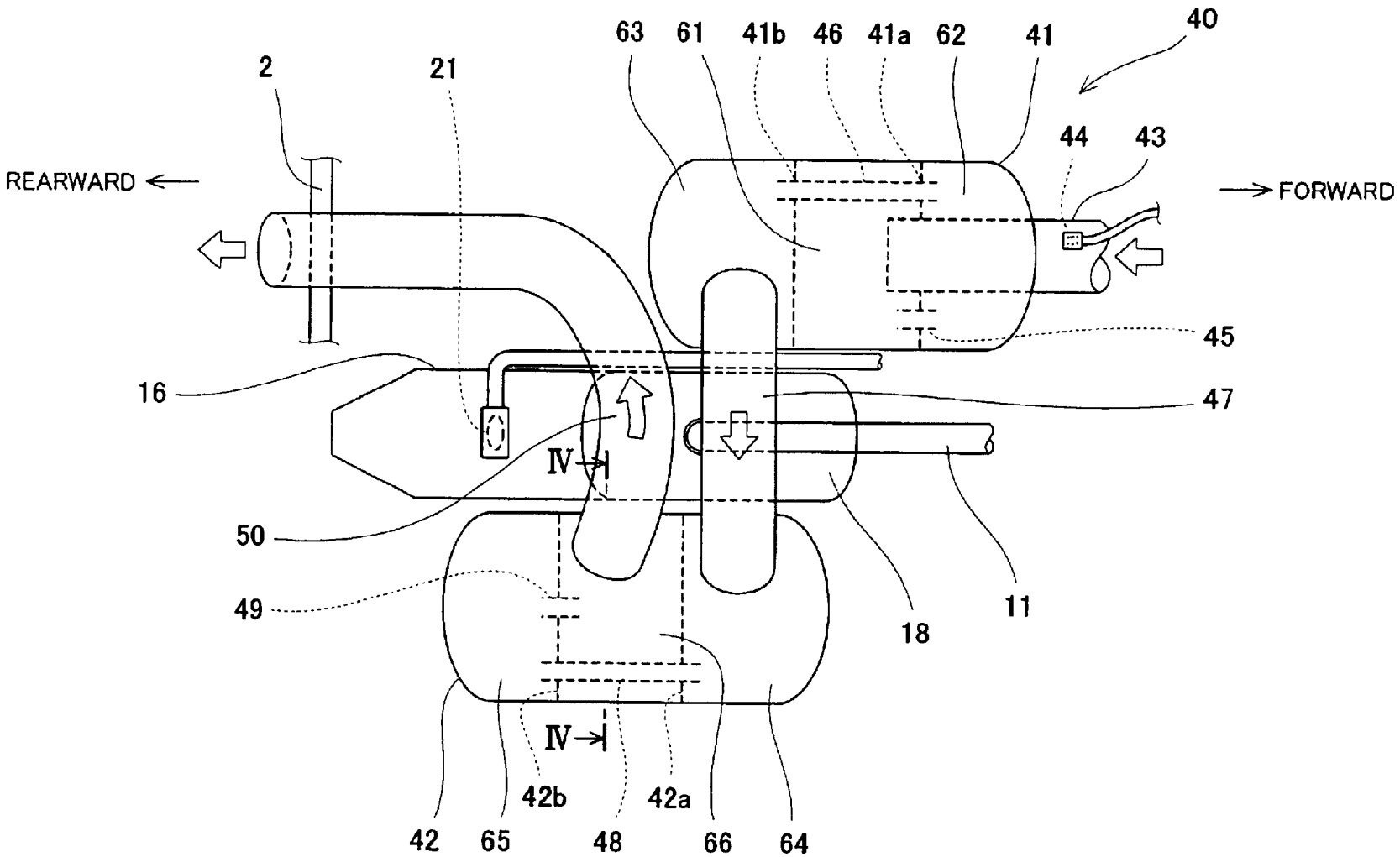
FIG. 3 is a schematic plan view showing a construction of the exhaust system in FIG. 2.

FIG. 3 is a schematic plan view showing a construction of the exhaust system 40. As shown in FIG. 3, the exhaust system 40 comprises a first exhaust chamber 41 and a second exhaust chamber 42 provided on a left side and a right side of the pump casing 16, respectively. The first exhaust chamber 41 is located on an upstream side and a second exhaust chamber 42 located on a downstream side in a flow passage of an exhaust gas. Hereinbelow, "upstream" and "downstream" are defined from the perspective of the flow of the exhaust gas in the exhaust system 40. The first and second exhaust chambers 41 and 42 are both water mufflers configured to reduce an energy of the exhaust gas containing water supplied at a position of a first exhaust pipe 43 to be described later.

The first and second exhaust chambers 41 and 42 are respectively tubular and are closed at both ends. The first exhaust chamber 41 extends along the longitudinal direction of the watercraft and is located on the left side of the water passage 18 and the pump casing 16 (see FIG. 2). The second exhaust chamber 42 extends along the longitudinal direction of the watercraft and is located on the right side of the water passage 18 and the pump casing 16.

The first exhaust chamber 41 has an inner space divided into three spaces arranged in the longitudinal direction. The spaces are defined by two separating walls 41*a* and 41*b* provided forward and backward in the longitudinal direction. Specifically, the exhaust gas flows within the inner space of the first exhaust chamber 41 in the following order: a first space 61 located at the center, a second space 62 located forward, and a third space 63 located rearward.

The first exhaust pipe 43 is connected to an exhaust port (not shown) of the engine E through an exhaust manifold (not shown) and penetrates a front end portion of the first exhaust chamber 41, the second space 62, and the separating wall 41*a*, and communicates with the first space 61. A water-supply port 44 is provided on a side wall portion of the first exhaust pipe 43. Some of the cooling water drawn through the water-drawing hole 21 provided on the pump casing 16 is supplied to an exhaust passage of the first exhaust pipe 43 through the water-supply port 44.

The first and second spaces 61 and 62 communicate with each other through a small-diameter communicating pipe 45 penetrating the separating wall 41*a*. The second and third spaces 62 and 63 communicate with each other through a small-diameter communicating pipe 46 penetrating the first space 61 and the separating walls 41*a* and 41*b*, with the first space 61 interposed between them.

The second exhaust chamber 42 has an inner space divided into three spaces arranged in the longitudinal direction. The spaces are defined by separating walls 42*a* and 42*b* provided forward and backward in the longitudinal direction. More specifically, the exhaust gas flows within the inner space of the second exhaust chamber 42 in the following order: a fourth space 64 located in front, a fifth space 65 located rearward, and a sixth space 66 located at the center.

The third space 63 of the first exhaust chamber 41 communicates with the fourth space 64 of the second exhaust chamber 42 through a second exhaust pipe 47 traversing over the water passage 18 and the pump casing 16. The fourth and fifth spaces 64 and 65 communicate with each other through a small-diameter communicating pipe 48 penetrating the sixth space 66 and the separating walls 42*a* and 42*b*, with the sixth space 66 interposed between them. The fifth and sixth spaces 65 and 66 communicate with each other through a small-diameter communicating pipe 49 penetrating the separating wall 42*b*.

A third exhaust pipe 50 is connected to the second exhaust chamber 42 such that its upstream end portion protrudes and opens into the sixth space 66. A downstream portion of the third exhaust pipe 50 traverses over the pump casing 16 and extends to the left. The downstream portion of the third exhaust pipe 50 further extends rearward to penetrate a rear portion of the hull 2 and communicates with the outside of the watercraft.

Figure 4:
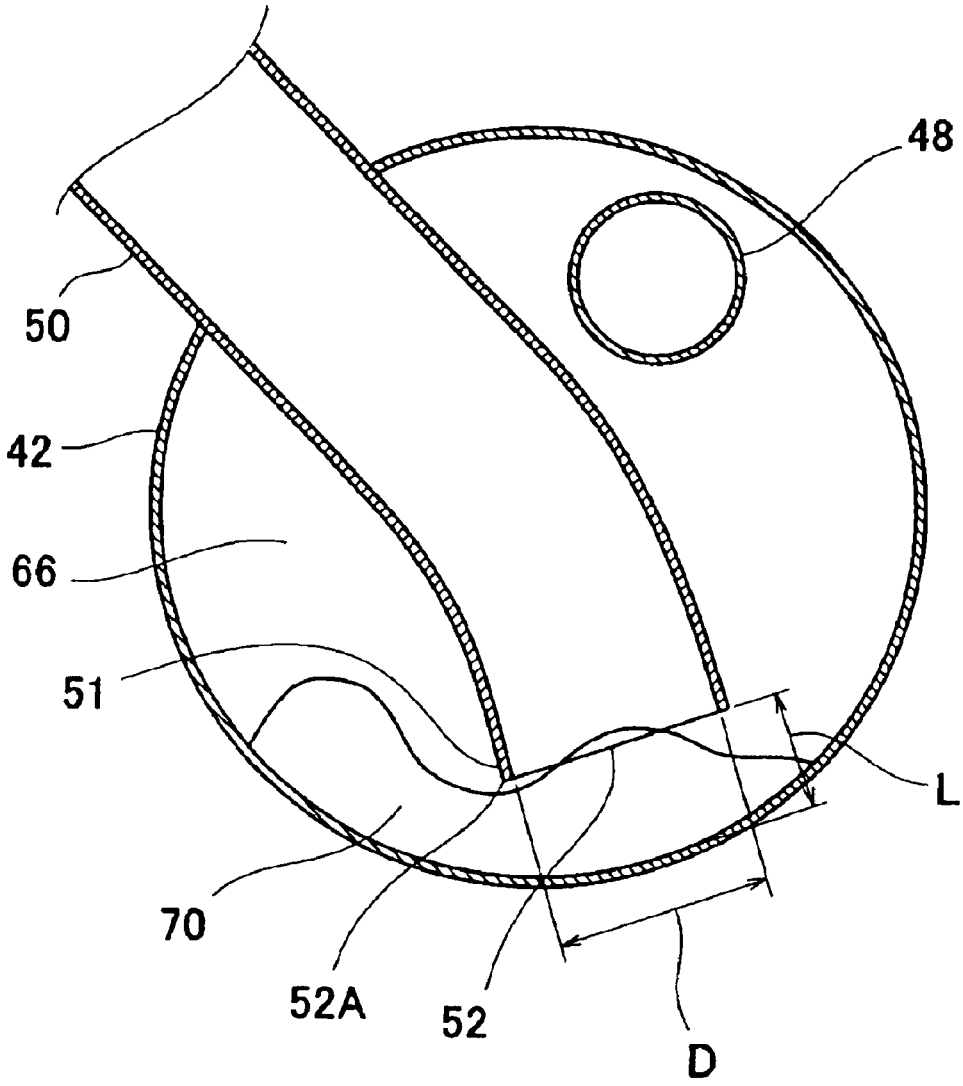
FIG. 4 is a cross-sectional view taken along line IV—IV in FIG. 3, showing an upstream end portion of a third exhaust pipe protruding into a second exhaust chamber.

FIG. 4 is a cross-sectional view taken along line IV—IV in FIG. 3, showing the upstream end portion 51 of the third exhaust pipe 50 protruding into the second exhaust chamber 42 in the exhaust system 40 in FIG. 3. As shown in FIG. 4, the upstream end portion 51 of the third exhaust pipe 50 protrudes into the sixth space 66 of the second exhaust chamber 42 and opens substantially downward. Herein, an upstream opening end face 52 of the upstream end portion 51 is slightly inclined with respect to a horizontal plane. The upstream opening end face 52 is located above to be spaced apart from an inner surface of the second exhaust chamber 42. Specifically, the upstream opening end face 52 is located above to be spaced apart from an inner surface of the sixth space 66, by a distance L that satisfies the following formula (1):

$$D/3 \leqq L \leqq D \quad (1)$$

In the formula (1), L represents a distance between the upstream opening end face 52 and the inner surface of the second exhaust chamber 42, which is opposed to the upstream opening end face 52, and D represents a diameter of the flow passage at an upstream opening end 52A of the third exhaust pipe 50. It should be appreciated that the diameter D is substantially equal to the diameter of the flow passage of the upstream end portion 51, and when the third exhaust pipe 50 has, for example, an oval cross-section, its average diameter may be used as the diameter D. The formula (1) is set based on a volume of part of the sixth space 66 below the upstream opening end face 52 and a back pressure of the exhaust gas. The back pressure of the exhaust gas decreases with an increase in the distance L, while the exhaust noise decreases with a decrease in the distance L. Therefore, when the formula (1) is satisfied, the back pressure of the exhaust gas and the exhaust noise are properly in balance.

The exhaust gas flows within the exhaust system 40 in FIG. 3 as follows. As shown in FIG. 3, the exhaust gas from the engine E (see FIG. 2) flows rearward through the exhaust manifold (not shown) and into the first space 61 of the first exhaust chamber 41 through the first exhaust pipe 43. While the exhaust gas is flowing within the first exhaust pipe 43, water is supplied to the exhaust gas from the water-supply hole 44. Within the first space 61, the exhaust gas flows in a reverse direction, and forward from the first space 61 into the second space 62 through the communicating pipe 45. Within the second space 62, the exhaust gas flows in a reverse direction again and rearward into the third space 63 through the communicating pipe 46. Then, the exhaust gas flows from the third space 63 of the first exhaust chamber 41 to the fourth space 64 of the second exhaust chamber 42 through the second exhaust pipe 47.

Then, the exhaust gas flows rearward from the fourth space 64 to the fifth space 65 through the communicating pipe 48. Within the fifth space 65, the exhaust gas flows in a reverse direction and forward into the sixth space 66 through the communicating pipe 49. Further, the exhaust gas is discharged outside the watercraft through the third exhaust pipe 50.

The exhaust gas expands and compresses repeatedly while flowing within the first to sixth spaces 61 to 66. As a result, the energy of the exhaust gas is reduced, and the resulting exhaust gas is discharged. Also, since the exhaust gas flows forward and rearward through the first to sixth spaces 61 to 66 while changing its direction repeatedly, the energy of the exhaust gas is further reduced.

While the engine E is operating at a high speed, the water supplied to the exhaust gas from the water-supply hole 44 is diffused by the high-speed and large-amount exhaust gas, and converted into mist, most of which is discharged outside the watercraft. On the other hand, while the engine E is operating at a low speed, the water supplied to the exhaust gas drops to inner bottom portions of the first exhaust chamber 41 and the second exhaust chamber 42.

FIG. 4 shows water 70 remaining within the sixth space 66 of the second exhaust chamber 42 while the engine E is operating at a low speed. While the engine E is operating at a low speed, i.e., in an idling state, an average water level of the water 70 remaining within the sixth space 66 is substantially equal to a distance from the inner surface of the second exhaust chamber 42 to the upstream opening end face 52 of the third exhaust pipe 50.

In the exhaust system 40 of this embodiment, since the upstream end portion 51 of the third exhaust pipe 50 is structured so as to satisfy the formula (1), the water 70 remaining in the second exhaust chamber 42 is relatively small in amount. So, the ratio of the volume of the water 70 to a volume of the second exhaust chamber 42 is small and, hence, the volume of the second exhaust chamber 42 is not satisfactorily reduced. Therefore, the second exhaust chamber 42 sufficiently functions as an expansion chamber to reduce the noise of the exhaust gas.

As shown in FIG. 4, the water 70 remaining within the second exhaust chamber 42 becomes somewhat turbulent due to vibration of the engine E and shake of the watercraft. However, in the exhaust system 40, the water 70 remaining within the second exhaust chamber 42 is relatively small in amount, and becomes less turbulent. As a result, the exhaust noise generated due to the turbulent water is small. In addition, since the distance L that satisfies the formula (1) is determined in view of the back pressure of the exhaust gas, the exhaust noise is reduced while inhibiting degradation of engine performance due to the back pressure of the exhaust gas.

Figure 5:
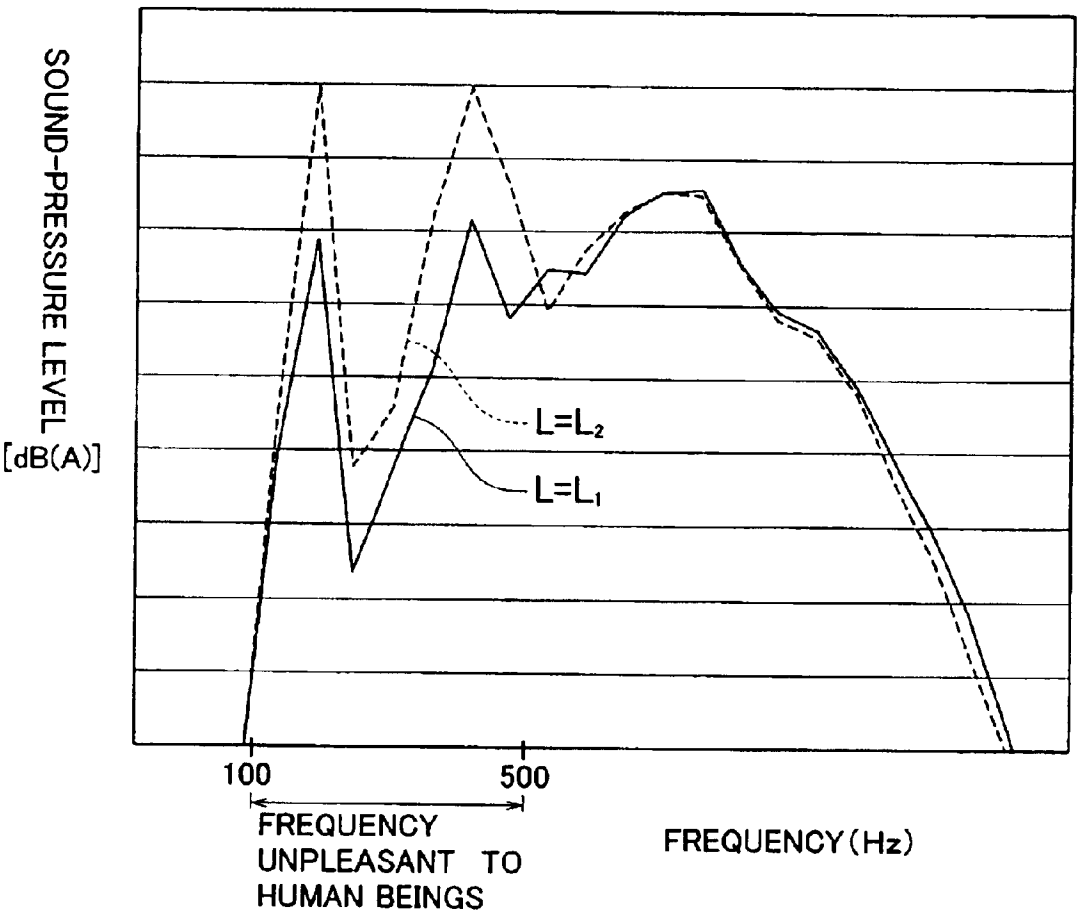
FIG. 5 is a graph showing a relationship between a sound-pressure level of the exhaust gas from the exhaust system in FIG. 2 relative to each frequency and a distance between an upstream opening end face of the third exhaust pipe and an inner surface of the second exhaust chamber, under the condition in which the engine is operating at a low speed.

FIG. 5 is a graph showing a relationship between a sound-pressure level of the exhaust gas relative to each frequency and the distance L in the exhaust system 40 during a low-speed operation of the engine E. FIG. 5 shows that the distance L is substantially equal to one third the diameter D (the distance L=L1: represented by a solid line) and the distance L is substantially equal to the diameter D (the distance L=L2: represented by a broken line).

As shown in FIG. 5, in a frequency range (approximately 100 Hz to 500 Hz) which is particularly unpleasant to human beings, a sound-pressure level of the exhaust noise is lower when the distance L is set to L1 rather than when the distance L is set to L2, i.e., when the upstream opening end face 52 of the third exhaust pipe 50 is closer to the inner surface of the second exhaust chamber 42. According to analysis, difference in sound-pressure level in this frequency range is 4[dB(A)] at maximum, and the energy of the exhaust noise in the case of the distance L1 is equal to approximately 40% of the energy of the exhaust noise in the case of the distance L2.

As should be appreciated, by setting the distance L smaller and by locating the upstream opening end face 52 of the third exhaust pipe 50 as close to the inner surface of the second exhaust chamber 42 as possible, the exhaust noise can be effectively reduced. However, as the distance L is set smaller, a gap between the upstream opening end face 52 of the third exhaust pipe 50 and the inner surface of the second exhaust chamber 42 becomes smaller and the back pressure of the exhaust gas becomes correspondingly higher. According to experiments conducted by inventors, it is desirable that the distance L satisfy the formula (1) and more desirable that the distance L satisfy $D/3 \leqq L \leqq 2D/3$. When $D/3 \leqq L \leqq 2D/3$ is satisfied, reduction of the exhaust noise is compatible with inhibition of an increase in the back pressure of the exhaust gas.

Figure 6:
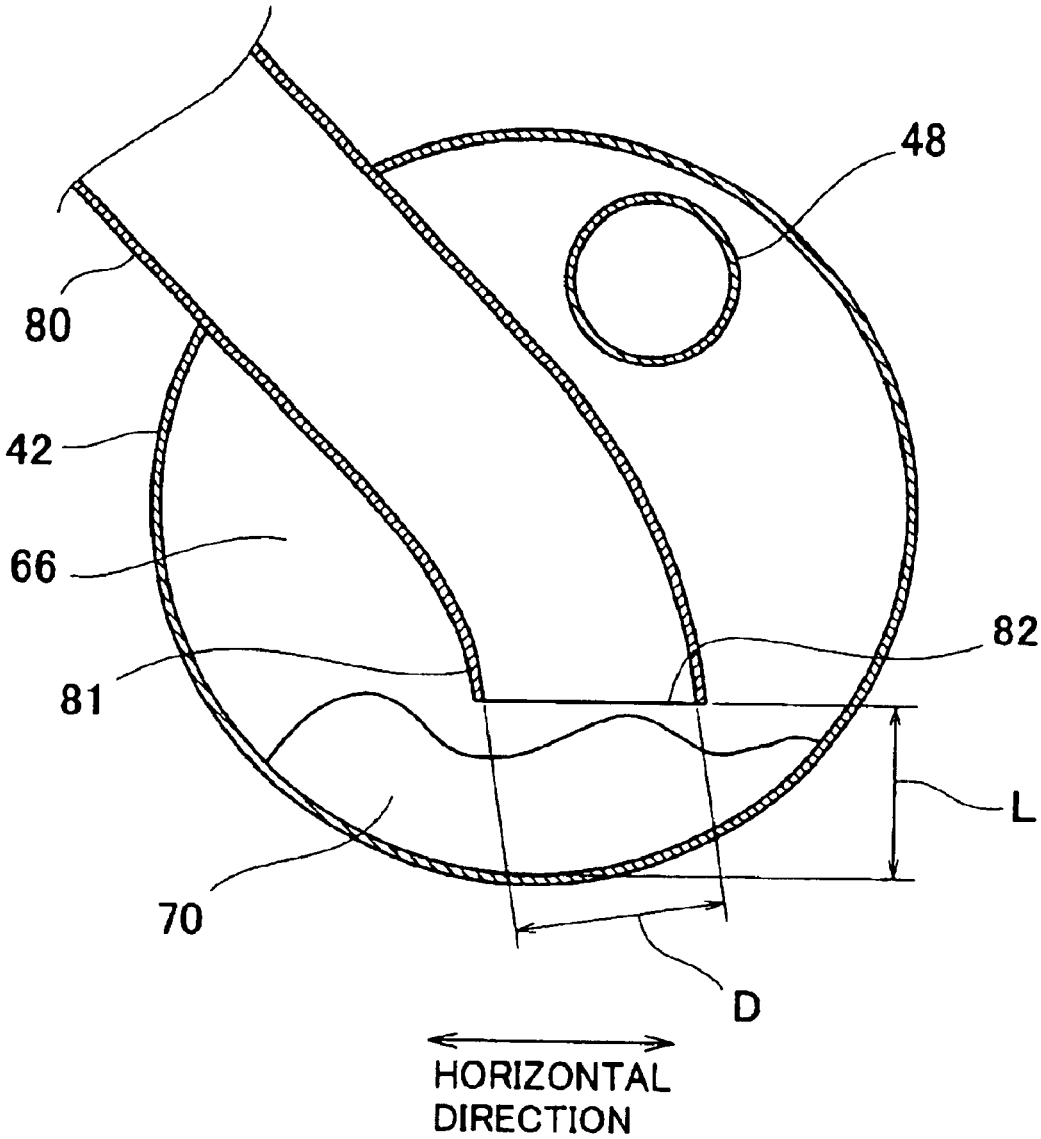
FIG. 6 is a cross-sectional view showing an upstream end portion of a third exhaust pipe, which has a shape different from that of the third exhaust pipe in FIG. 4.

The structure of the upstream end portion 51 of the third exhaust pipe 50 is not intended to be limited to that shown in FIG. 4. FIG. 6 is a cross-sectional view showing another structure of the upstream end portion of the third exhaust pipe 50 in FIG. 4. When comparison is made between the third exhaust pipe 50 in FIG. 4 and the third exhaust pipe 80 in FIG. 6, the upstream opening end face 52 of the third exhaust pipe 50 is inclined, whereas an upstream opening end face 82 of the third exhaust pipe 80 is horizontal.

In the case of the second exhaust chamber 42 in FIG. 6, the level of the water 70 remaining in a static state within the sixth space 66 during a low-speed operation of the engine E is substantially as high as the upstream opening end face 82. Since the structure of the upstream opening end face 82 of the third exhaust pipe 80 affects the noise of the exhaust gas, the noise of the exhaust gas can be further reduced by horizontally providing the upstream opening end face 82.

In the exhaust system 40, the first and second exhaust chambers 41 and 42 are arranged along the flow passage of the exhaust gas. Alternatively, the exhaust system 40 may comprise three or more exhaust chambers, or only one exhaust chamber. When the exhaust system 40 comprises a plurality of exhaust chambers along the flow passage of the exhaust gas, it is preferable that the present invention be applied to the exhaust chamber located through which the exhaust gas flows last. By doing so, it becomes possible to inhibit generation of the exhaust noise and leakage of the exhaust noise to outside the watercraft.

The noise caused by the turbulent water within the exhaust chamber is mostly generated at the upstream end portion of the exhaust pipe connected to an exhaust gas outlet of the exhaust chamber. Therefore, it is desirable to apply the present invention to the upstream end portion. Specifically, in the exhaust system 40 in FIG. 3, it is desirable to apply the present invention to the upstream end portion of the second exhaust pipe 47 which is connected to the first exhaust chamber 41 or the upstream end portion of the third exhaust pipe 50 which is connected to the second exhaust chamber 42.

Because this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. An exhaust system for a small watercraft, comprising:

an exhaust chamber having a predetermined volume, within which an exhaust gas discharged from an engine flows, the exhaust gas containing water supplied at a position of the exhaust system; and an exhaust pipe configured to allow an inside of the exhaust chamber and an outside of the watercraft to communicate with each other, and having an upstream end portion in a flow passage of the exhaust gas, which is connected to the exhaust chamber and a downstream end portion in the flow passage of the exhaust gas, which is connected to a body of the watercraft so as to open outside the watercraft, the exhaust pipe being configured to discharge the exhaust gas from the exhaust chamber outside the watercraft, wherein the upstream end portion of the exhaust pipe is configured to protrude into the exhaust chamber to a vicinity of a lower end of the exhaust chamber and has an upstream opening end face that opens substantially downward in the exhaust chamber so as to be spaced apart a predetermined distance from an inner surface of the exhaust chamber which is opposed to the upstream opening end face, and wherein the predetermined distance between the inner surface of the exhaust chamber and the upstream opening end face satisfies a formula represented by:

$$D/3 \leq L \leq D$$

where L is a distance between the upstream end face of the exhaust pipe and the inner surface of the exhaust chamber which is opposed to the upstream opening end face, and D is an inner diameter of the upstream end portion of the exhaust pipe.

2. The exhaust system for a small watercraft according to claim 1, wherein the upstream opening end face of the exhaust pipe is substantially horizontal.

3. The exhaust system for a small watercraft according to claim 1, further comprising:

a water jet pump configured to extend in a longitudinal direction of the watercraft and to propel the watercraft;

wherein the exhaust chamber comprises a first exhaust chamber provided on one side of the water jet pump to be located on an upstream side in the flow passage of the exhaust gas and a second exhaust chamber provided on an opposite side of the water jet pump to be located on a downstream side in the flow passage of the exhaust gas and configured to communicate with the first exhaust chamber through a pipe member provided to extend in a lateral direction of the watercraft over the water jet pump, and the upstream end portion of the exhaust pipe is connected to the second exhaust chamber.

4. The exhaust system for a small watercraft according to claim 1, wherein the upstream opening end face of the exhaust pipe opens obliquely downward, and the upstream opening end of the exhaust pipe is spaced substantially equally apart from the inner surface of the exhaust chamber which is opposed to the upstream opening end face, over an entire periphery of the upstream opening end.

5. A water-jet propulsion personal watercraft, comprising:

a water jet pump configured to extend in a longitudinal direction of the watercraft and to propel the watercraft;

an engine configured to drive the water jet pump;

a first exhaust chamber and a second exhaust chamber, each having a predetermined volume, within each of which an exhaust gas discharged from the engine flows, the exhaust gas containing water supplied at a position of an exhaust system equipped in the watercraft, the first exhaust chamber being provided on one side of the water jet pump to be located on an upstream side in the flow passage of the exhaust gas, and the second exhaust chamber being provided on an opposite side of the water jet pump to be located on a downstream side in the flow passage of the exhaust gas and configured to communicate with the first exhaust chamber through a pipe member provided to extend in a lateral direction of the watercraft over the water jet pump; and an exhaust pipe configured to allow an inside of the second exhaust chamber and an outside of the watercraft to communicate with each other, and having an upstream end portion in a flow passage of the exhaust gas, which is connected to the second exhaust chamber and a downstream end portion in the flow passage of the exhaust gas, which is connected to a body of the watercraft so as to open outside the watercraft, the exhaust pipe being configured to discharge the exhaust gas from the second exhaust chamber outside the watercraft, wherein the upstream end portion of the exhaust pipe is configured to protrude into the second exhaust chamber to a vicinity of a lower end of the second exhaust chamber and has an upstream opening end face that opens substantially downward in the second exhaust chamber so as to be spaced apart a predetermined distance from an inner surface of the second exhaust chamber which is opposed to upstream opening end face, and wherein the predetermined distance between the inner surface of the second exhaust chamber and the upstream opening end face satisfies a formula represented by:

$$D/3 \leqq L \leqq D$$

where L is a distance between the upstream end face of the exhaust pipe and the inner surface of the second exhaust chamber which is opposed to the upstream opening end face, and D is an inner diameter of the upstream end portion of the exhaust pipe.

* * * * *